US012313357B2

(12) United States Patent
Botke

(10) Patent No.: US 12,313,357 B2
(45) Date of Patent: May 27, 2025

(54) FLEXIBLE HINGE BASED TRIGGER FOR A FIREARM

(71) Applicant: Agency Arms, LLC, Caldwell, ID (US)

(72) Inventor: Matt Botke, Caldwell, ID (US)

(73) Assignee: Agency Arms, LLC, Caldwell, ID (US)

( * ) Notice: Subject to any disclaimer, the term of this patent is extended or adjusted under 35 U.S.C. 154(b) by 3 days.

(21) Appl. No.: 18/349,238

(22) Filed: Jul. 10, 2023

(65) Prior Publication Data

US 2023/0358493 A1 Nov. 9, 2023

Related U.S. Application Data

(63) Continuation of application No. 17/508,936, filed on Oct. 22, 2021, now Pat. No. 11,740,046.

(60) Provisional application No. 63/106,618, filed on Oct. 28, 2020.

(51) Int. Cl.
*F41A 19/10* (2006.01)
*F41A 17/46* (2006.01)

(52) U.S. Cl.
CPC ..... *F41A 19/10* (2013.01); *F41A 17/46* (2013.01)

(58) Field of Classification Search
CPC ..... F41A 19/10; F41A 19/16
USPC ..... 42/69.01, 69.02, DIG. 1
See application file for complete search history.

(56) References Cited

U.S. PATENT DOCUMENTS 1,285,885 A * 11/1918 Younger ..... F41A 19/10 42/69.01
3,650,174 A * 3/1972 Nelsen ..... F41A 19/58 42/84
5,074,190 A * 12/1991 Troncoso ..... F41A 19/10 42/69.01
10,775,122 B1 * 9/2020 Rofkahr, Jr. ..... F41A 19/11
2020/0292265 A1 9/2020 Gheorghita

FOREIGN PATENT DOCUMENTS

AT 15313 U1 * 3/2017 ..... F41A 17/46
DE 102009029951 A1 12/2010
GB 722582 A * 1/1955 ..... F41A 19/33

* cited by examiner

*Primary Examiner* — Reginald S Tillman, Jr.
(74) *Attorney, Agent, or Firm* — Eversheds Sutherland (US) LLP

(57) ABSTRACT

A mechanism using flexure hinges as part of the trigger and/or safety mechanism of a firearm. Flexure hinges provide relative motion between two stiff members by the elastic deformation of an arbitrarily shaped flexible connector often implemented in metallic and composite materials. The flexure hinges are formed by flexure links connecting two stiff members. The flexure links connect various parts of the trigger assembly, such as a trigger component, including a shoe, plate, or safety, to a housing of the firearm. A method of creating the mechanism provides a trigger component, a housing, and connects the two parts by a flexure link with a flexure hinge.

8 Claims, 7 Drawing Sheets

FLEXIBLE HINGE BASED TRIGGER FOR A FIREARM

CROSS-REFERENCE TO RELATED APPLICATIONS

The disclosure claims priority to and the benefit of U.S. application Ser. No. 17/508,936, filed Oct. 22, 2021, which claims priority to and the benefit of U.S. Provisional Application No. 63/106,618, filed Oct. 28, 2020, which are all hereby incorporated by reference herein in their entirety.

FIELD

The present application is related to triggers for firearms and more specifically to triggers that use a flexure hinge.

BACKGROUND

Beneficial aspects of firearm design including incorporating lighter weight components, designing less complicated components, and incorporating firearm parts that require less maintenance. Typical hinges include a bore in which a pin is inserted. Hinges with a bore and pin can require a substantial amount of space. More so, traditional hinges with pins typically require lubrication or hysteresis, which can take up further space and may allow little to no tensile movement. Traditional hinges also may require the use of springs to, for example, return the shoe of a trigger back into a repeated position, as typical hinge and pin systems do not return to one position. Thus, there is a need for an improved hinge mechanism used in firearms.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION

Figure 1A:
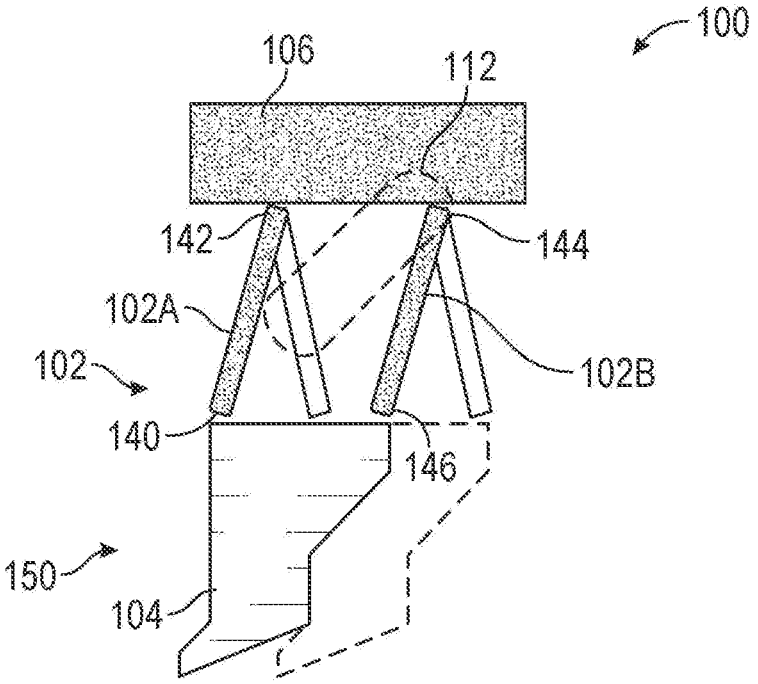
FIGS. 1A, 1B, and 1C illustrate a flexure-based mechanism as part of a trigger for a firearm in accordance with the principles of the present disclosure.

The present invention relates to a mechanism using flexure hinges as part of the trigger and/or safety mechanism of a firearm. Flexure hinges provide relative motion between two stiff members by the elastic deformation of an arbitrarily shaped flexible connector often implemented in metallic and composite materials. Living hinges are often associated with plastic materials and function in a very similar fashion but with different underlying deformation physics.

The present disclosure contemplates all types of relatively thin connecting elements between relatively stiff members to form a flexure, with the connecting elements and flexure being made of the same material, such that the flexure provides an approximately rotational degree of freedom that is substantially equivalent in application. The thin connecting elements and the stiff members may be monolithic and homogeneous, e.g., formed from a single piece, separable or discrete elements, or any combination thereof. Motion of flexure-based mechanisms is typically confined in a single plane. Accordingly, flexure-based mechanisms possess relatively high stiffness out of the plane. Additionally or alternatively, multiple flexure-based mechanisms may be combined to achieve any desired type of motion, e.g., in more than one plane.

The present disclosure relates to a mechanism of using flexures as part of the trigger and/or safety mechanism. Unlike pin and hinge systems, flexures are more tamper resistant. The flexure mechanism is typically difficult to modify given the monolithic parts or non-separable parts that comprise the mechanism. For safety purposes, modifications to critical systems of a firearm like the trigger assembly may be desired. The flexure also provides more precise motion, with certain embodiments including XY stages with nanometer travel. Flexure hinges are also easier to produce and assemble given the simplicity of the parts. The lack of a sliding motion between pins and hinges also reduces friction within the firearm, so that flexure hinges have less wear than pins and hinges. Further, pins and hinges are more susceptible than flexures to corrosion and contaminants due to the bores trapping foreign matter.

Flexure mechanisms as currently produced may have less travel ability than pin and hinges, but this can be designed around by changing key elements of the flexible element, such as materials, connection method, width b, length of the thin member 1, and total length F. Combinations of traditional parts or hinges with flexures is thus also embodied within. In addition, firearm components and specifically firearm triggers are often limited of travel by design, such as due to safeties or trigger stops. Thus, flexure based designs as specifically applied to firearms overcome the issue of travel ability.

Flexure based trigger mechanisms also are compatible with many typical manufacturing processes, including, but not limited to, electrical discharge machining, traditional subtractive machining, additive manufacturing, molding, and extruding.

Flexure Hinge Based Trigger system

FIG. 1A is a cross-section view of a flexure hinge based trigger system 100 according to one or more embodiments of the disclosure. The trigger system 100 may include a housing 106, a shoe 104, and at least one flexure link 102. The at least one flexure link 102 may comprise a first flexure link 102A and a second flexure link 102B. Any number of flexure links may be used herein. As discussed in greater detail below, the at least one flexure link 102 may be integral with the housing 106 and a trigger component 150, e.g., the shoe 104. The at least one flexure link 102 may comprise at least one flexure hinge (140, 142, 144, 146) at connections between the flexure link and any other part of the flexure hinge based trigger system 100. The trigger system can also have normal pin and hinge systems or any other hinge system. The flexure links 102 may be formed between any two relatively stiff members where movement is required. As shown in FIG. 1A, flexure hinge 142 may be formed by a thin connecting element between two relatively stiff members, e.g., the housing 106 and a first flexure link 102A. Similarly, flexure hinge 140 may be formed by a thin connecting element between two relatively stiff members, e.g., the trigger component 150, e.g., the shoe 104 and a first link 102A, flexure hinge 146 may be formed by a thin connecting element between two relatively stiff members, e.g., the trigger component 150, e.g., the shoe 104, and a second link 102B, and flexure hinge 144 may be formed by a thin connecting element between two relatively stiff members, e.g., the housing 106 and the second link 102B. As shown in FIG. 1A, the shoe 104 may be moved between a first position and a second position denoted by the dashed lines. The small sweep angle of travel of a first link 102A and a second link 102B make the flexure-based mechanism a viable option. Moreover, the trigger bar 112 illustrated in FIG. 1A may also be attached to a first link 102A or a second link 102B using a third link.

Figure 1B:
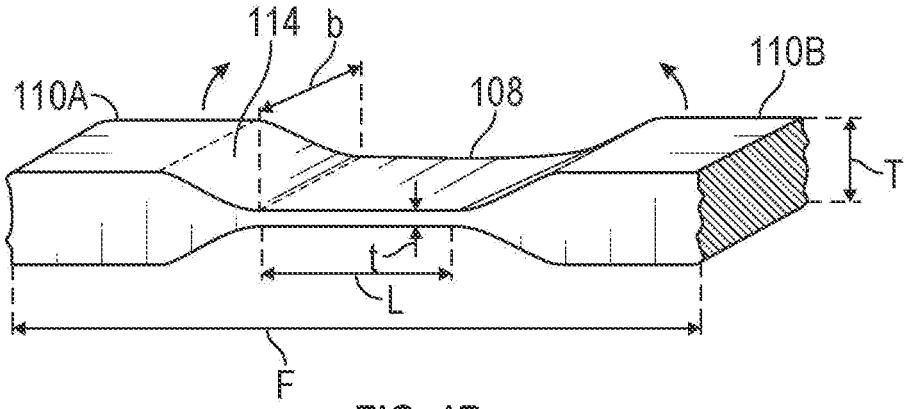
Figure 1C:
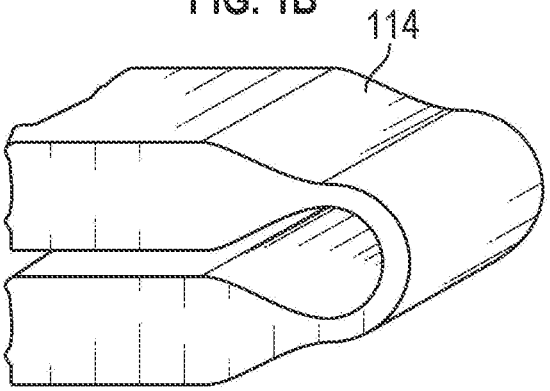

The at least one flexure link 102 can connect any two relatively stiff members that are configured to allow movement. The at least one flexure link 102 can, for example, connect the shoe 104 to the housing 106, a first link 102A to a trigger bar 112, the shoe 104 to a base plate, the shoe 104 to a safety, a safety to the base plate, the base plate to the housing 106, the base plate to the trigger bar 112, or any other combination between two relatively stiff members configured to allow movement. The at least one flexure link 102 has multiple dimensions shown in FIGS. 1B and 1C, including a width b, a length of the thinner or varying section L, and a total length from connection to connection of F. The at least one flexure link 102 can be adjusted by varying the aforementioned dimensions, or adjusted by changing the materials and various shapes. Possible materials include metal, composite, plastics, or combinations thereof. Virtually any shape can be used for a flexure hinge, but the typical shape here is a thin flat piece 108 L connected to a thicker piece 110. This particular shape helps reduce lateral movement, but other shapes can be used if other movement is either desired or not an issue. Some of the at least one flexure links 102 may have a section 114 where the thin flat piece 108 L transitions to a thicker piece 110. The thin flat piece 108 may have a thickness t compared to the thickness T of the thicker piece 110. This particular shape may have a stronger connection than a sharp transition from thin to thick.

The first flexure link 102A extend from the trigger component 150 to the housing 106. The first flexure link 102A is connected to the trigger component 150, in this case the shoe 104 on one end with a flexure hinge 140. The first flexure link 102A is also connected to the housing 106 by a second flexure hinge 142. The first flexure link may be any shape. In one embodiment, the first flexure link is as shaped in FIG. 1B, where the thicker piece 110A of one end is connected to the shoe 104 or is the shoe 104 itself. The thicker piece 110B on the other side of the thin flat piece 108 may be in the center of the first flexure link 102A, where another thin flat piece 108 is disposed on the other side of 110B and connects to another thicker piece that connects to the housing 106 or is the housing 106 itself.

The second flexure link 102B may extend from the trigger component 150 to the housing 106. The second flexure link 102B is connected to the trigger component 150, in this case the shoe 104 on one end with a flexure hinge 146. The second flexure link 102B is also connected to the housing 106 by a second flexure hinge 144. The second flexure link may be any shape. In one embodiment, the second flexure link is as shaped in FIG. 1B, where the thicker piece 110A of one end is connected to the shoe 104 or is the shoe 104 itself. The thicker piece 110B on the other side of the thin flat piece 108 may be in the center of the second flexure link 102B, where another thin flat piece 108 is disposed on the other side of 110B and connects to another thicker piece that connects to the housing 106 or is the housing 106 itself.

In some embodiments, the trigger component 150 is the shoe 104. The shoe 104 of the trigger system allows for movement of the entire trigger system by actuating the shoe 104 between a first position and a second position. The first and second position are shown in solid and phantom lines respectively in FIG. 1A. When the shoe 104 moves from the first to the second position, the at least one flexure links 102 may move to a second position due to their connection to the housing 106.

The housing 106 of the trigger system provides linkages and structure to allow for the pivoting of the shoe 104 and the at least one flexure links 102. The housing may be a separate structure within the trigger assembly. The housing 106 can also comprise a mechanism to limit the travel of the shoe 104 and flexure hinges, such as a trigger stop. The housing 106 may be configured to not move at all or may be configured to move less than the movement of the shoe 104 to cause movement of the trigger bar 112.

The trigger bar 112 connects the rest of the trigger system 112 to a firing mechanism within the rest of the firearm (not shown). The trigger bar may be connected to the rest of the trigger system by a flexure hinge between the trigger bar 112 and any of the at least one flexure links 102, or can be connected to the shoe 104. The trigger bar 112 can be any trigger bar suitable for use in a firearm.

Figure 2A:
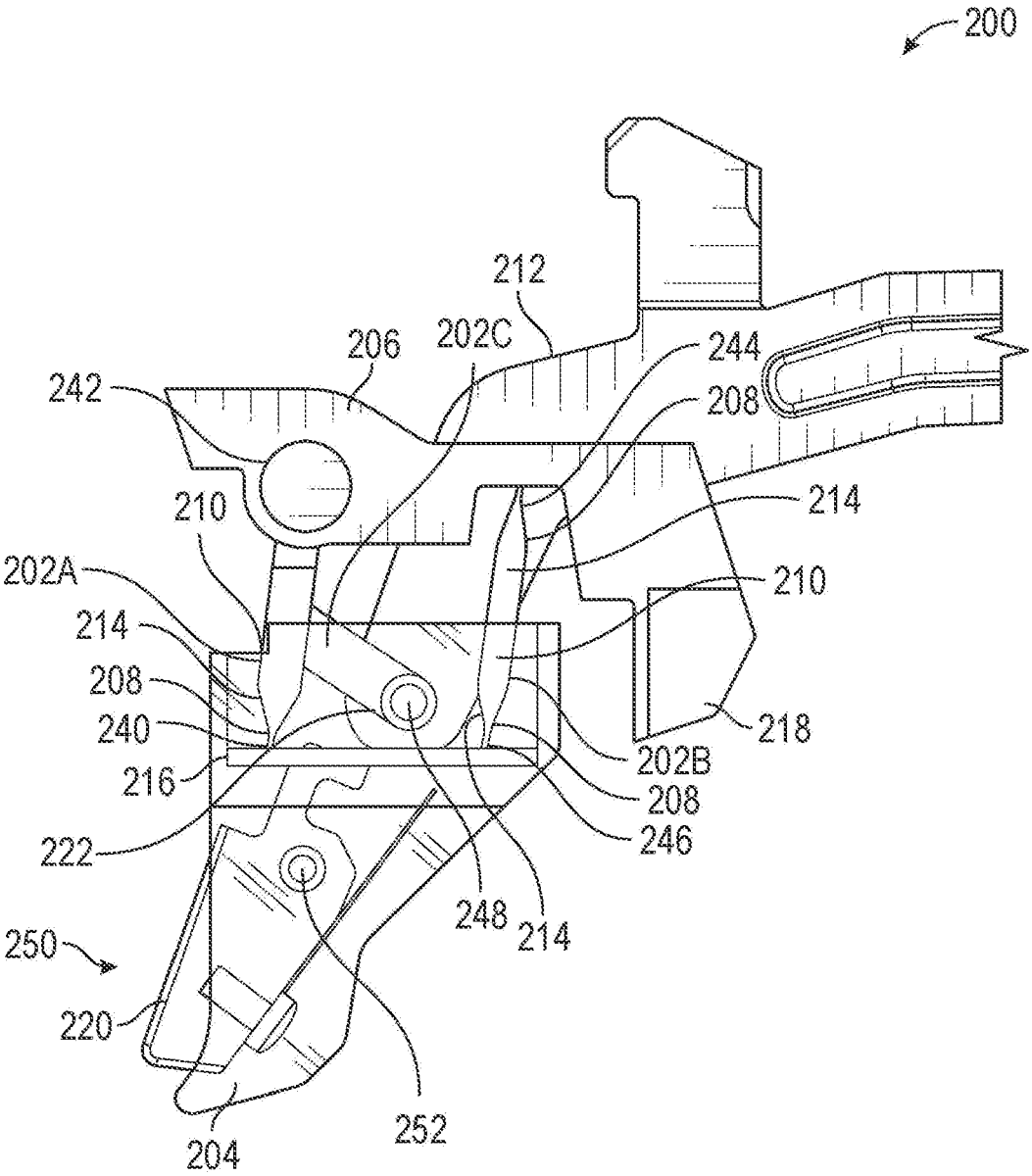
FIG. 2A illustrates a flexure-based mechanism of a trigger in battery in accordance with one or more embodiments of the present disclosure.
Figure 2B:
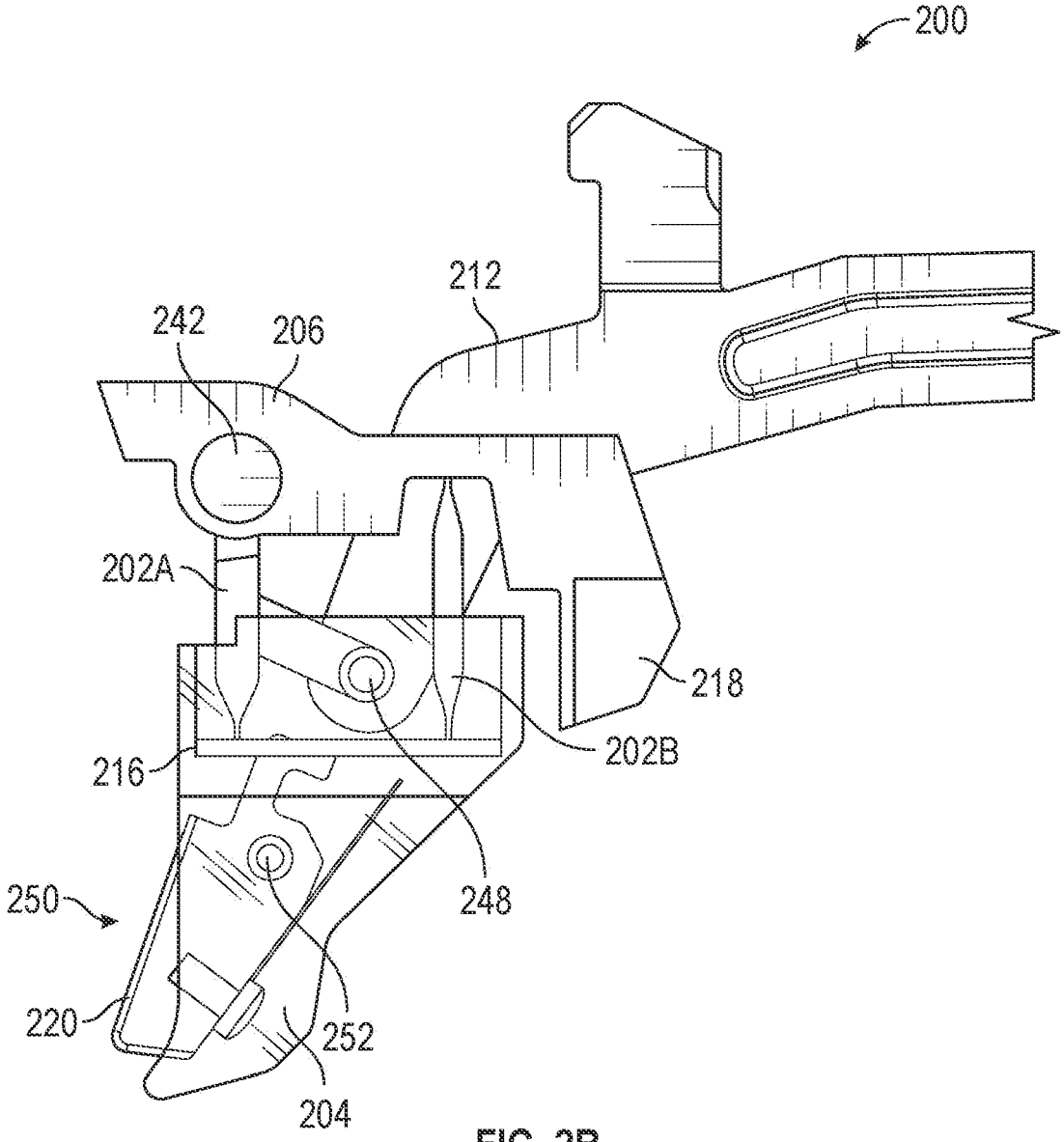
FIG. 2B illustrates a flexure-based mechanism of a trigger in mid-travel in accordance with one or more embodiments of the present disclosure.
Figure 2C:
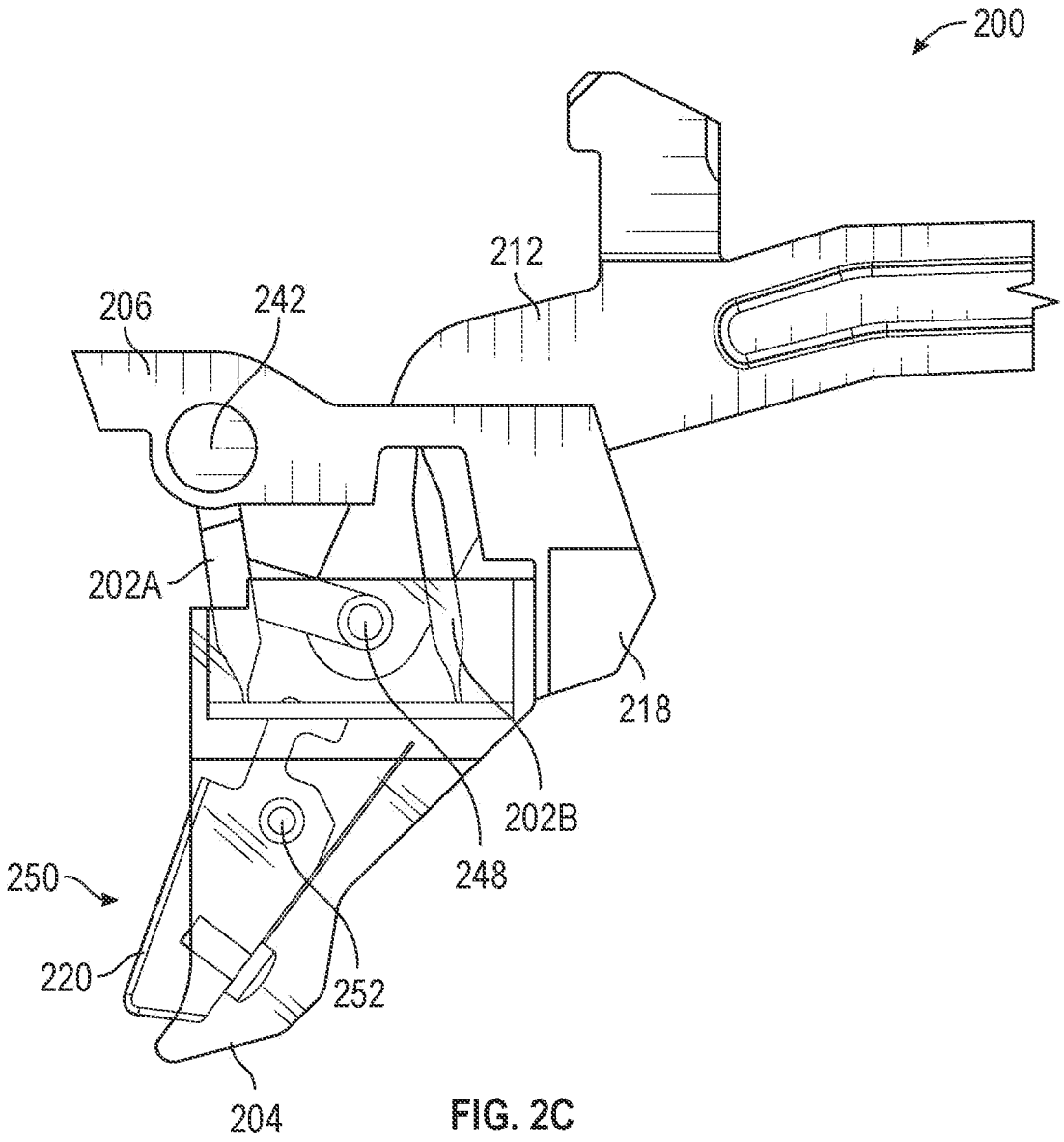
FIG. 2C illustrates a flexure-based mechanism of a trigger in full travel in accordance with one or more embodiments of the present disclosure.

FIGS. 2A-2C are a cross-section view of a flexure hinge based trigger system 200 according to one or more embodiments of the disclosure. The trigger system 200 may include a housing 206, a shoe 204, at least one flexure link 202. As discussed in greater detail below, the at least one flexure link 202 may be integral with the housing 206 and a trigger component 250, e.g., the shoe 204, the plate 216, or the safety 220. The at least one flexure link 102 may comprise at least one flexure hinge 240, 244, 246 at connections between the flexure link and any other part of the flexure hinge based trigger system 100. The trigger system can also have normal pin and hinge systems or any other hinge system 242, 248, 252. The flexure links 202 may be formed between any two relatively stiff members where movement is required. As shown in FIG. 2A, a hinge 242 may be formed by a hinge and pin system connecting the housing 206 and a first flexure link 202A. Flexure hinge 240 may be formed by a thin connecting element between two relatively stiff members, e.g., the plate 216 and a first link 202A, flexure hinge 246 may be formed by a thin connecting element between two relatively stiff members, e.g., the plate 216 and a second link 202B, and flexure hinge 244 may be formed by a thin connecting element between two relatively stiff members, e.g., the housing 206 and the second link 202B. As shown in FIGS. 2A-2C, the shoe 204 may be moved between a first position and a second position. The small sweep angle of travel of a first link 202A and a second link 202B make the flexure-based mechanism a viable option. Moreover, the trigger bar 212 illustrated in FIG. 2A may also be attached to a first link 202A or a second link 202B using a third link 202C.

The at least one flexure link 202 can connect any two relatively stiff members that are configured to allow movement. The at least one flexure link 202 can, for example, connect the plate 216 to the housing 206, a first link 202 to a trigger bar 212, the shoe 204 to a base plate 216, the shoe 204 to a safety 220, a safety 220 to the base plate 216, the base plate 216 to the housing 206, the base plate 216 to the trigger bar 112, or any other combination between two relatively stiff members configured to allow movement. The at least one flexure link 202 has multiple dimensions shown in FIGS. 1A and 1B, including a width B, a length of the thinner or varying section L, and a total length from connection to connection of F. The at least one flexure link 202 can be adjusted by varying the aforementioned dimensions, or adjusted by changing the materials and various shapes. Possible materials include metal, composite, plastics, or combinations thereof. Virtually any shape can be used for a flexure hinge, but the typical shape here is a thin flat piece 108 L connected to a thicker piece 110. This particular shape helps reduce lateral movement, but other shapes can be used if other movement is either desired or not an issue. Some of the at least one flexure links 202 may have a section 114 where the thin flat piece 108 L transitions to a thicker piece 110. This particular shape may have a stronger connection than a sharp transition from thin to thick.

The first flexure link 202A extend from the trigger component 250 to the housing 206. The first flexure link 202A is connected to the trigger component 250, in this case the plate 216 on one end with a flexure hinge 240. The first flexure link 202A is also connected to the housing 206 by a hinge with a pin 242. The first flexure link 202A may be any shape. In one embodiment, the flexure link is shaped as shown in FIGS. 2A-2C. The first flexure link 202A has the thicker piece 210 on one end, a section 214 where the thin flat piece 208 L transitions to a thicker piece 210, and the thin flat piece 208 is connected to the plate 216, which acts as another thicker piece.

The second flexure link 202B may extend from the trigger component 250 to the housing 206. The second flexure link 202B is connected to the trigger component 250, in this case the plate 216 on one end with a flexure hinge 246. The second flexure link 202B is also connected to the housing 206 by a second flexure hinge 244. The second flexure link may be any shape. In one embodiment, the flexure link is shaped as shown in FIGS. 2A-2C. The second flexure link 202B has the thicker piece 210, a section 214 where the thin flat piece 208 L transitions to a thicker piece 210, and the thin flat piece 208 is connected to the plate 216, which acts as another thicker piece. The second flexure link 202B also has another a section 214 where the thin flat piece 208 L transitions to a thicker piece 210, and the thin flat piece 208 is connected to the housing 206, which acts as another thicker piece.

The shoe 204 of the trigger system allows for movement of the entire trigger system by actuating the shoe 204 between a first position and a second position. The first and second position are shown respectively in FIGS. 2A and 2C. The shoe 204 may fit over a plate 216 that is connected to the at least one flexure link 202. When the shoe 204 moves from the first to the second position, the plate 216 moves with it, and the at least one flexure links 202 move to a second position due to their connection to the housing 206. The shoe 204 may be connected over the top of the safety 220 and the plate 216 by a hinge and pin 252.

The housing 206 of the trigger system provides linkages and structure to allow for the pivoting of the plate 216 and the at least one flexure links 202. The housing 206 may be a separate structure within the trigger assembly. The housing 206 can also contain a mechanism to limit the travel of the shoe 204 and flexure hinges, such as a trigger stop 218 or backstop.

The trigger bar 212 connects the rest of the trigger system 212 to a firing mechanism within the rest of the firearm (not shown). The trigger bar may be connected to the rest of the trigger system by third flexure link 202C with a flexure hinge or a hinge with a pin 248 between the trigger bar 212 and any of the at least one flexure links 202A, 202B with a flexure hinge (not shown), or can be connected to the shoe 204 or base plate 216 via either a flexure hinge or a hinge with a pin (not shown). The trigger bar 212 can be any trigger bar 212 suitable for use in a firearm.

A plate 216 of the trigger system may be connected to the at least one flexure links 202. The plate 216 may be flat, curved, or any shape configured to attach to the at least one flexure links. The plate 216 may be an integral part of the shoe 204, or may fit inside of the shoe 204. The plate 216 may move with movement of the shoe 204 or the safety 220. The plate 216 may be coupled to the safety 220 by another flexure link or by another attachment means.

A trigger stop 218 may form a part of the housing 206. The trigger stop 218 may be configured to limit the travel of a trigger component 250, such as the plate 216, shoe 204, and safety 220, and thereby prevent overstressing the flexure hinges.

A safety 220 may be coupled to the shoe 204 via a pin, screw, or other method. In one embodiment, as shown in FIG. 2A, the safety is coupled to the shoe via hinge and pin 252. The safety 220 may be configured such that in order for the shoe 204 to move and thus move the flexure links 202A, 202B, 202C and the trigger bar 212, the safety 220 must first be actuated. The safety 220 may be formed by two flexure links with a hinge in between the two flexure links, such that both segments are connected via similar flexure hinges as between flexure hinges 240 and 244.

In some embodiments, as shown in FIGS. 2A-2C, the trigger component 250 is multiple trigger components, specifically the shoe 204, safety 220, and plate 216. The flexure links 202A, 202B connected to the housing 206 and a trigger component 250 connect to the plate 216 as shown in FIGS. 2A-2C.

Figure 3:
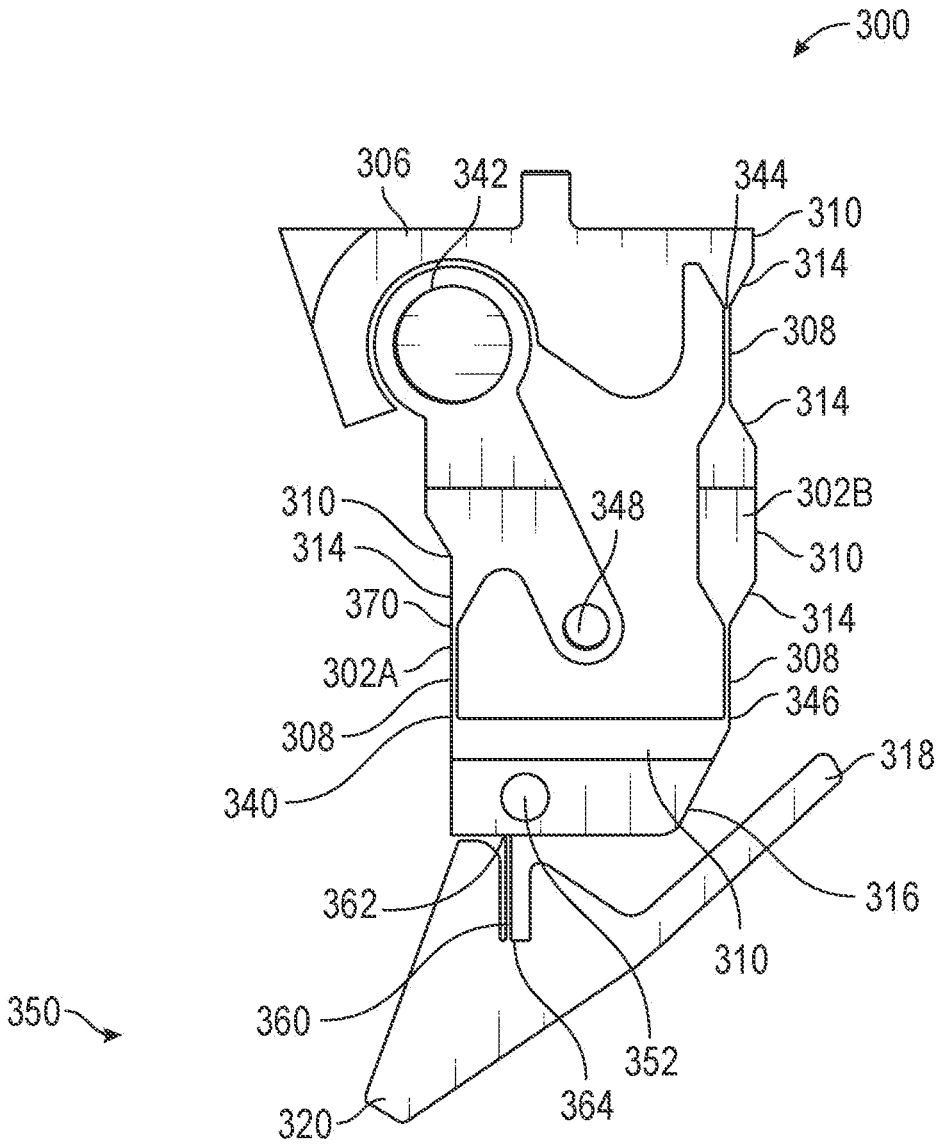
FIGS. 3 and 4 illustrate a flexure-based mechanism of a trigger in accordance with one or more embodiments of the present disclosure.

FIG. 3 is a cross-section view of a flexure hinge based trigger system 300 according to one or more embodiments of the disclosure. The trigger system may include a housing 306, a safety 320, and at least one flexure link. The at least one flexure link may comprise a first flexure link 302A, a second flexure link 302B, and a third flexure link 360. Any number of flexure links may be used herein. As discussed in greater detail below, the at least one flexure link 302 may be integral with the housing 106 and a trigger component 350, e.g., the plate 316, the safety 320, or the shoe 304. The at least one flexure link 302, 360 may comprise at least one flexure hinge (340, 344, 346, 360, 362, 370) at connections between the flexure link and any other part of the flexure hinge based trigger system 100 The trigger system can also have normal pin and hinge systems or any other hinge system (342, 348, 252). The flexure links 302, 360 may be formed between any two relatively stiff members where movement is required. As shown in FIG. 3, flexure hinge 370 may be formed by a thin connecting element between two relatively stiff members, e.g., the hinge and pin 342 and a first flexure link 302A. Similarly, flexure hinge 340 may be formed by a thin connecting element between two relatively stiff members, e.g., the plate 316 and a first link 302A, flexure hinge 346 may be formed by a thin connecting element between two relatively stiff members, e.g., the plate 316 and a second link 302B, and flexure hinge 344 may be formed by a thin connecting element between two relatively stiff members, e.g., the housing 306 and the second link 302B. The shoe 304 may be moved between a first position and a second position. The small sweep angle of travel of a first link 302A and a second link 302B make the flexure-based mechanism a viable option.

The at least one flexure link 302 can connect any two relatively stiff members that are configured to allow movement. The at least one flexure link 302 can, for example, connect the plate 316 to the housing 306, a first link 302 to a trigger bar, the shoe 304 to a base plate 316, the shoe 304 to a safety 320, a safety 320 to the base plate 316, the base plate 316 to the housing 306, the base plate 316 to the trigger bar, or any other combination between two relatively stiff members configured to allow movement. The at least one flexure link 302 has multiple dimensions, including a width b, a length of the thinner or varying section L, and a total length from connection to connection of F. The at least one flexure link 302 can be adjusted by varying the aforementioned dimensions, or adjusted by changing the materials and various shapes. Possible materials include metal, composite, plastics, or combinations thereof. Virtually any shape can be used for a flexure hinge, but the typical shape here is a thin flat piece 308 L connected to a thicker piece 310. This particular shape helps reduce lateral movement, but other shapes can be used if other movement is either desired or not an issue. Some of the at least one flexure links 302 may have a section 314 where the thin flat piece 308 L transitions to a thicker piece 310. One flexure link can contain multiple thin flat pieces 308. This particular shape may have a stronger connection than a sharp transition from thin to thick.

The first flexure link 302A extend from the trigger component 350 to the hinge with a pin 342 connected to the housing 306. The first flexure link 302A is connected to the trigger component 350, in this case the plate 316 on one end with a flexure hinge 340. The first flexure link 302A is also connected to the housing 306 by a hinge with a pin 342, where the first flexure link 302A has another flexure hinge 370 between the first flexure link 302A and the hinge with a pin 342. The first flexure link 302A may be any shape. In one embodiment, the flexure link is shaped as shown in FIG. 3. The first flexure link 302A has the thicker piece 210 on one end, a section 314 where the thin flat piece 308 L transitions to a thicker piece 310, and the thin flat piece 308 is connected to the plate 316, which acts as another thicker piece.

The second flexure link 302B may extend from the trigger component 350 to the housing 306. The second flexure link 302B is connected to the trigger component 350, in this case the plate 316 on one end with a flexure hinge 346. The second flexure link 302B is also connected to the housing 306 by a second flexure hinge 344. The second flexure link may be any shape. In one embodiment, the flexure link is shaped as shown in FIG. 3. The second flexure link 302B has a thicker piece 310 in the center of the flexure link 302B, as well as thicket sections on each end 310. The second flexure link 302B also has a section 314 where the thin flat piece 208 L transitions to a thicker piece 310, and the thin flat piece 308 is connected to the plate 316, which acts as another thicker piece. The second flexure link 202B also has another a section 314 where the thin flat piece 308 L transitions to a thicker piece 310, and the thin flat piece 308 is connected to the housing 306, which acts as another thicker piece.

Figure 4:
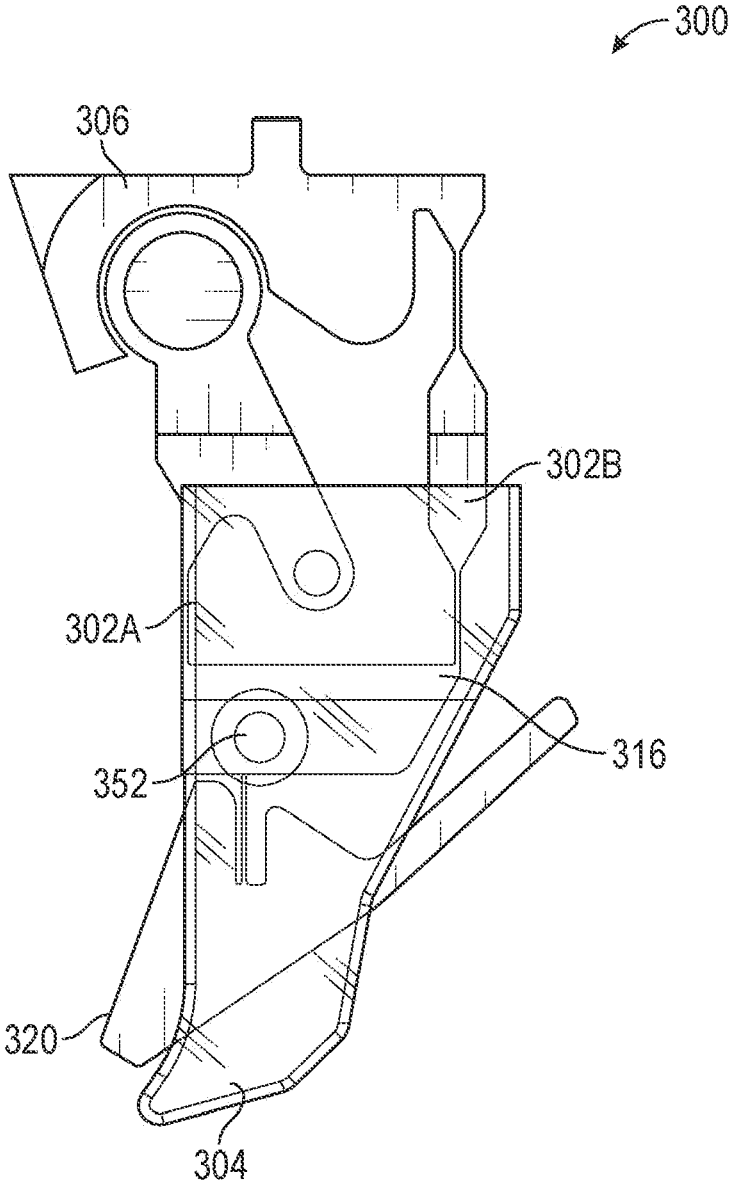

The shoe 304 of the trigger system allows for movement of the entire trigger system by actuating the shoe 304 between a first position and a second position. The shoe 304 may fit over a plate 316 that is connected to the at least one flexure link 302. The shoe 304 may be the trigger alone or may be the trigger in combination with a safety mechanism. As shown in FIG. 4, the shoe 304 may be connected to the plate 316 by a hinge and pin 352. The shoe may also extend further up to over at least one of the flexure hinges 340, 344, 346, 370 between the plate 316 and the housing 306.

The housing 306 of the trigger system provides linkages and structure to allow for the pivoting of the plate 316 and the at least one flexure links 302. The housing may be a separate structure within the trigger assembly. The housing can also contain a mechanism to limit the travel of the shoe 304 and flexure hinges, such as a trigger stop.

The trigger bar (not shown) connects the rest of the trigger system to a firing mechanism within the rest of the firearm (not shown). The trigger bar may be connected to the rest of the trigger system by a flexure hinge or a regular hinge 348 between the trigger bar and one of the at least one flexure links 302A, 302B, can be connected to the hinge and pin 342 connecting the housing 306 and the first flexure link 302, or can be connected to the shoe 304 or base plate 316. The trigger bar can be any trigger bar suitable for use in a firearm.

A plate 316 of the trigger system may be connected to the at least one flexure links 302. The plate 316 may be flat, curved, or any shape configured to attach to the at least one flexure links. The plate 316 may be an integral part of the shoe 304, or may fit inside of the shoe 304. The plate 316 may move with movement of the shoe 304 or the safety 320. The plate 316 may be coupled to the safety by another flexure link or by another attachment means. The plate may contain a hinge and pin 352 to connect the shoe 304 to the rest of the trigger system.

A safety 320 may be coupled to the shoe 304 via a pin, screw, or other method. The safety 320 may be configured such that in order for the shoe 304 to move and thus move the flexure links 302, the safety 320 must first be actuated. The safety 320 may be formed by a flexure link 360 with a flexure hinge 362 between the flexure link 360 and the plate 316 and a hinge 364 between the flexure link 360 and the safety 320. The safety 320 may actuate until a portion of the safety 322 is stopped by the plate 316, wherein the portion of the safety 322 acts similarly to the backstop 218 to prevent overstress of the flexure links. The safety 320 may be the trigger alone or may be the trigger in combination with a shoe 304.

Figure 5:
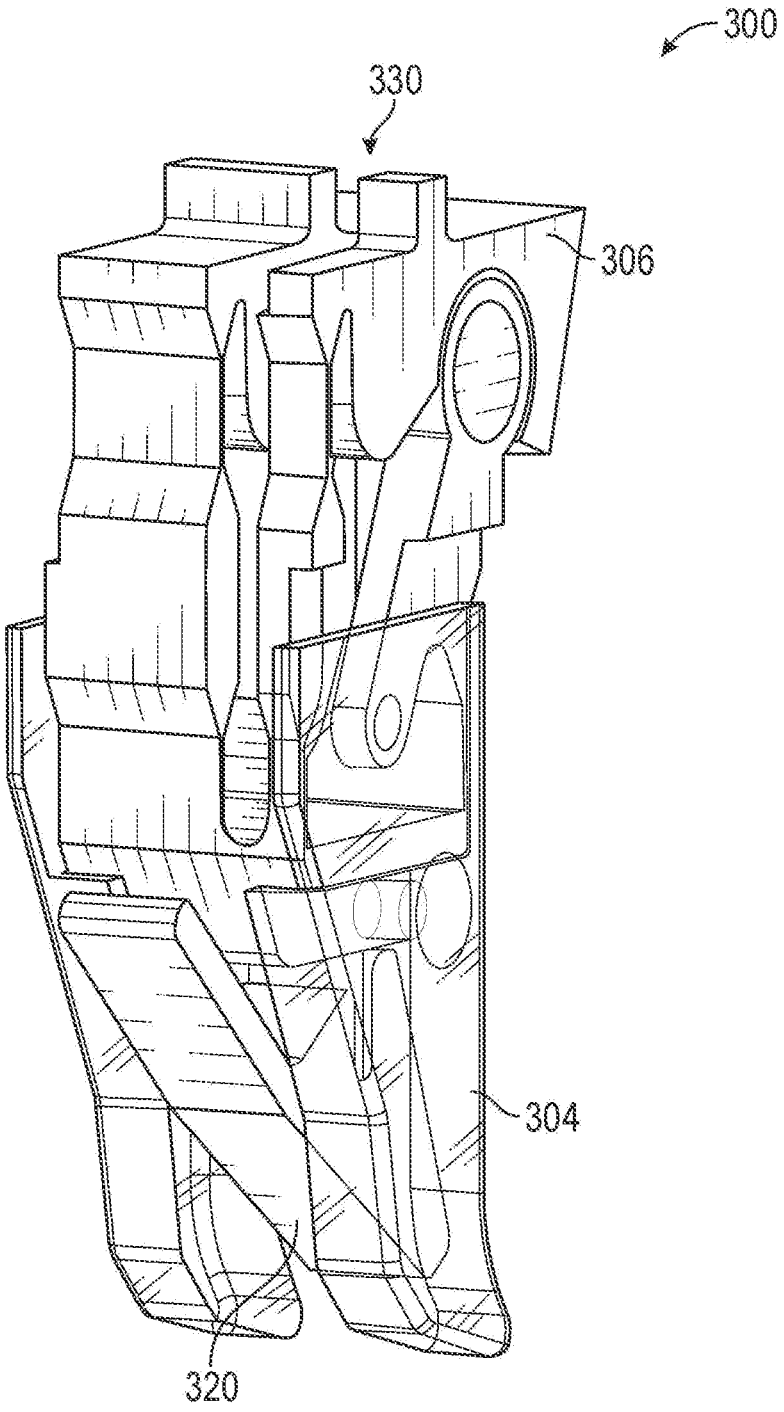
FIG. 5 illustrates a perspective view flexure-based mechanism of a trigger in accordance with one or more embodiments of the present disclosure.

The system may also have a gap 330, as shown in FIG. 5, that may or may not extend completely from top to bottom or from front to back. The gap 330 may be used for mounting the trigger onto the rest of the firearm.

In some embodiments, as shown in FIGS. 3-5, the trigger component 350 is multiple trigger components, specifically the shoe 304, safety 320, and plate 316. The flexure links 302A, 302B connected to the housing 306 and a trigger component 350 connect to the plate 316 as shown in FIGS. 3-4.

In some embodiments, as shown in FIG. 3, the third flexure link 360 connects the safety to the plate. The third flexure link 360 is one thin flat piece 308 and the safety and plate act as the thicker portions of the flexure hinges 362, 364.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

That which is claimed is:

1. A firearm trigger assembly, comprising:

a housing;

a trigger shoe; and a flexible link connecting the trigger component shoe and the housing, wherein the flexible link comprises a flexible hinge, wherein a trigger bar is connected to the flexible link, wherein the flexible link includes a thin component and a thicker component.

2. The firearm trigger assembly of claim 1, wherein the flexible link comprises a first flexible link and a second flexible link.

3. The firearm trigger assembly of claim 2, wherein the housing further comprises a trigger stop configured to restrict movement of the trigger shoe.

4. A method of producing a firearm trigger assembly, comprising: providing a first trigger shoe; and providing a housing connecting the housing to the trigger shoe by a flexible link, and further comprising: providing a trigger bar; and connecting the trigger bar to the flexible link, wherein the flexible link includes a thin component and a thicker component.

5. The firearm trigger assembly of claim 1, wherein the first flexible link forms a first flexible hinge with the housing and a second flexible hinge with the trigger shoe, and wherein the second flexible link forms a third flexible hinge with the housing and a fourth flexible hinge with the trigger shoe.

6. The firearm trigger assembly of claim 2, wherein the trigger component shoe comprises a first trigger component and a second trigger component, wherein the first trigger component shoe is a plate and the second trigger component is a shoe, and wherein the trigger component shoe connected to the housing by the flexure link is the plate.

7. The firearm trigger assembly of claim 6, wherein the trigger component shoe comprises a third trigger component, wherein the third trigger component is a safety attached to the shoe.

8. The firearm trigger assembly of claim 7, wherein the first flexible link and the second flexible link form two flexible hinges with the plate, and wherein the flexible hinge is formed by the flexible link as a thinner portion and the plate being a thicker portion.

* * * * *